United States Patent [19]

Honegger

[11] Patent Number: 4,478,259

[45] Date of Patent: Oct. 23, 1984

[54] REED FOR JET WEAVING MACHINES

[75] Inventor: Rolf Honegger, Durnten, Switzerland

[73] Assignee: Ruti Machinery Works, Ltd., Ruti, Switzerland

[21] Appl. No.: 352,559

[22] Filed: Feb. 26, 1982

[30] Foreign Application Priority Data

Mar. 5, 1981 [CH] Switzerland ..... 1466/81

[51] Int. Cl.[3] ..... D03D 47/30

[52] U.S. Cl. ..... 139/435; 139/192

[58] Field of Search ..... 139/435, 192; 226/97

[56] References Cited

U.S. PATENT DOCUMENTS 1,306,189 6/1919 Pickstone ..... 139/192

3,399,701 9/1968 Te Strake ..... 139/435

3,818,952 6/1974 Vermeulen et al. ..... 139/435

*Primary Examiner*—Henry Jaudon

*Attorney, Agent, or Firm*—Burns, Doane, Swecker & Mathis

[57] ABSTRACT

The reed dents for the reed of a jet weaving machine have recesses on their forward edges for guiding and beating-up the weft thread, and they are given a bend along their longitudinal extent so as to incline toward the fell of the fabric. The inclined upper half of the reed inclines forwardly and, when the batten is in its rear-most position, the upper reed cap is closer to the fell of the cloth than is the case when reed dents of known configuration are employed. Consequently, the harnesses can be positioned closer to the fell, with the result that the harness stroke is reduced and it becomes feasible to increase the r.p.m. of the weaving machine.

4 Claims, 1 Drawing Figure

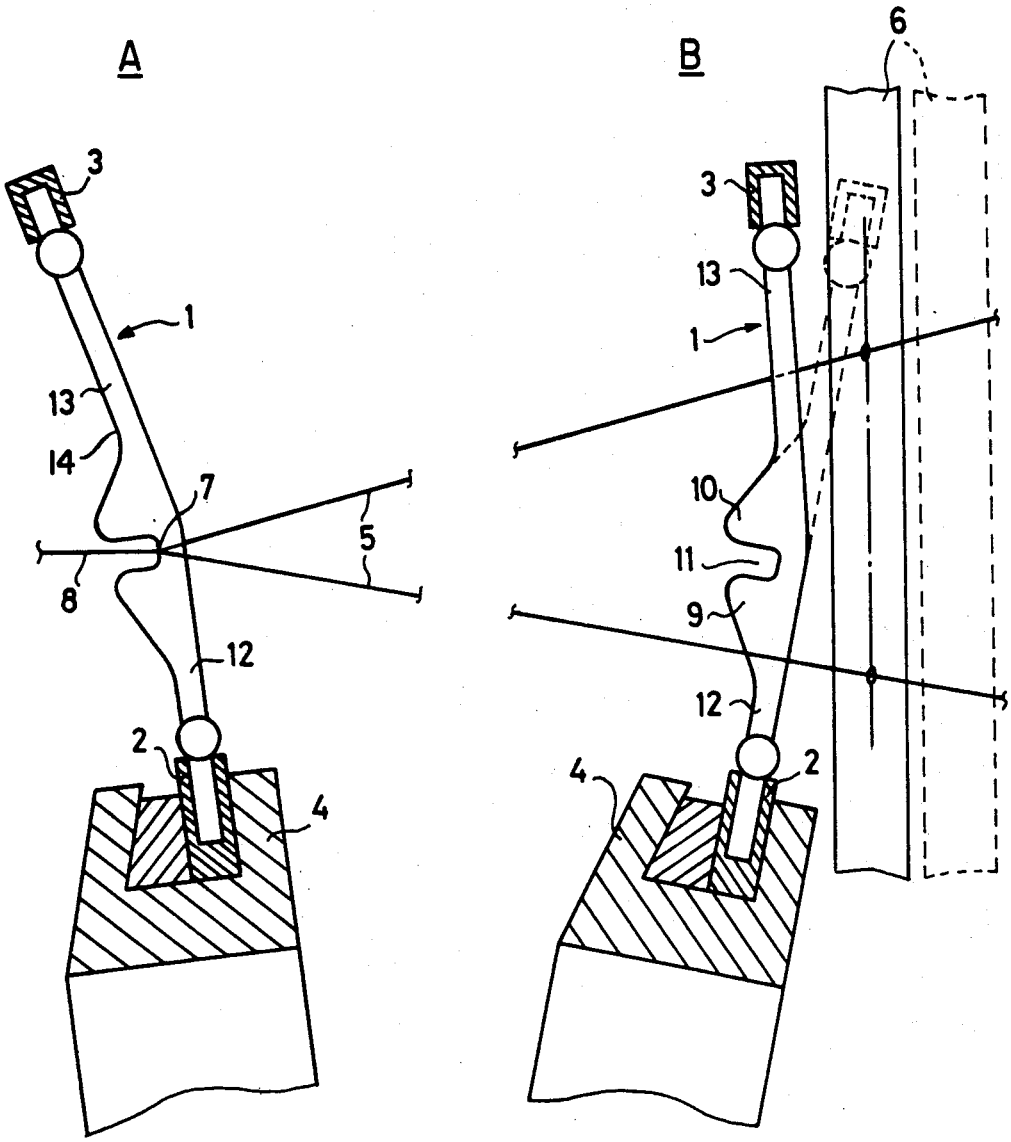
A
B
1
2
3
4
5
6
7
8
9
10
11
12
13
14

REED FOR JET WEAVING MACHINES

The invention relates to a reed dent for jet weaving machines, having a half-open recess on its forward edge for guiding and beating-up the weft thread.

A known reed dent of the general type with which the present invention is concerned is disclosed in U.S. Pat. No. 3,818,952. This reed dent has a flat, elongated shape and comprises a straight strip which is provided with two nose-shaped projections on its forward edge. The sides of these projections which face one another form the two sides of a U-shaped recess for guidingg and beating-up the weft thread. This type of reed dent has proved itself very well in practice and is currently in wide use.

Modern jet weaving machines have very high output rates. They are operated at high r.p.m., with a large number of weft insertions per minute. Recently it has become increasingly evident that a major factor limiting the r.p.m. is the shedding of the warp threads. As one continues to increase the r.p.m. of the machine, a point is reached where the shed-forming mechanisms cannot operate satisfactorily. Heretofore attempts have been made to overcome this deficiency by making improvements in the shed-forming mechanisms. This may be achieved by reducing the shed angle or the excursion of the batten. However, as a rule these two parameters have already been optimized to such an extent that further improvement is difficult. Moreover, such approaches involve extensive and costly retrofitting.

The present invention proceeds from the concept that one of the causes of the r.p.m.-limiting or r.p.m.-reducing effect of shed formation is the so-called harness stroke—the excursion which each harness must execute between its upper and lower positions. In other words, by reducing the harness stroke, the operating speed of the shed-forming mechanism can be increased.

The object of the invention is to provide a simple and inexpensive means by which the harness stroke can be shortened.

This object is accomplished according to the invention in that the reed dent is comprised of two arms which are mutually inclined, whereby the included angle on the edge of the reed dent which has the recess is less than 180°.

The bent configuration of the reed dent results in a reed with its upper part inclined toward the fell of the fabric being woven. The reed cap (i.e., the transversely extending structure which extends across the weaving machine and to which the upper ends of the reed dents are attached) is also forwardly disposed in comparison to the caps of reeds employing reed dents of the type known heretofore. The reed cap is the part which swings farthest downward with the motion of the batten, and its rearmost position determines the minimum possible distance between the first harness and the fell of the cloth. Since, in accordance with the present invention, the rearmost position of the reed cap is closer than normal to the fell of the cloth, the first harness, and thus all the other harnesses, also can be positioned closer to the fell. Therefore, for a given shed angle, the harness stroke can be shortened.

The invention further relates to a reed for jet weaving machines which employs reed dents of the above-mentioned inventive type and which has a guide channel for the weft thread. This channel extends over the width of the warp, is located on the forward side of the reed facing the fell, and is formed from the recesses in the reed dents.

The inventive reed is characterized in that it is comprised a lower part adjoining the batten and an upper part which is at an angle to the lower part and is inclined toward the fell.

The invention is described in more detail hereinafter, with reference to a preferred exemplary embodiment illustrated in the drawing which is a schematic cross sectional view through the warp shed of a pneumatic weaving machine, with the reed being shown in both the forwardmost position A and rearmost position B.

The reed is comprised of reed dents 1 with their ends held respectively in upper and lower transversely-extending members 3 and 2. The lower member 2 is affixed to the batten, in known fashion. The batten is swingably mounted on the machine frame via a hollow shaft and is connected to a drive mechanism (not shown). The drive mechanism serves to move the reed back and forth periodically between the two illustrated positions during the operation of the weaving machine.

Warp threads 5 are carried between the reed dents 1 in known fashion. These warp threads undergo shedding by means of heddles stretched in heddle frames. The heddles together with said frames form the harnesses. The forwardmost harness 6 is illustrated in the drawing. Each inserted weft thread is beaten-up against the fell 7 of the fabric 8 by means of the reed dents 1.

The forward edges 14 of the reed dents 1 (i.e., those edges which face the fell 7) are furnished with two nose-shaped projections 9 and 10. The lower edge of the upper projection 10 and the upper edge of the lower projection 9 face one another and form the two sides of a U-shaped recess 11. The recesses 11 of the reed dents 1 form a guide channel which extends over the width of the warp and which guides the weft thread which is blown by a flowing fluid such as air, during the insertion of said weft thread into the warp shed. The weft thread lying, after insertion, in the guide channel, is moved over to the fell 7 by the reed and is then beaten-up by the base edges of the U-shaped recesses 11 in the reed dents 1.

The illustrated reed dents 1 have a longitudinal bend in the direction inclined toward the fell 7. Each reed dent includes two mutually inclined arms 12 and 13. Their intersection point lies in the region of the recess 11; in the drawing the elevation of this point is approximately equal to that of the upper edge of the recess. The nose-shaped projection 9 is disposed on arm 12, and the nose-shaped projection 10 is disposed on arm 13.

A reed dent of known type is illustrated with dotted lines in the drawing. This reed dent does not have a bend but rather is straight. The lower arm of the known reed dent coincides with the lower arm 12 of the reed dent of the present invention. It extends along the radius from the center of pivotal movement of the batten as a whole. The upper arm 13 of the inventive reed dent of this invention is however inclined forwardly toward the fell 7. Accordingly, when the batten is in the rearmost position B of its swing (shown on the right in the drawing) the upper member 3 of the reed (i.e., the reed cap) is closer to the fell than is the case with known reed dents. Consequently, the first harness 6 (and thereby clearly all the other harnesses) can be positioned closer to the fell 7 than would be possible if the heretofore known reed dents were employed. This leads to a reduction of the harness stroke, in an amount which may exceed 10% with the shed and reed geometry shown.

The angle between the two arms 12 and 13 of the reed dent 1 is about 15°; this may vary depending on the shed geometry and distance through which the batten moves.

It is not essential in all instances that the two nose-shaped projections 9 and 10 on the forward edge of the reed dent 1 have the shape and dimensions illustrated.

Moreover, other modifications and various of the specifically disclosed subject matter will subject themselves to persons skilled in the art. It is intended therefore that the foregoing description can be considered as exemplary only and that the scope of the invention be ascertained from the following claims.

What is claimed is:

1. A reed dent for beating up a weft thread for jet weaving machines, said reed dent having a recess on a forward edge and disposed interiorly within the warp shed during weft insertion and arranged for guiding a weft thread, the reed dent including two arms which are mutually inclined and which include an angle of less than 180° on the forward edge of the reed dent, said recess is U-shaped and is formed by two generally parallel side edges and a base connecting said two side edges, said base edge being provided for beating-up the weft thread and said two side edges being disposed generally perpendicularly to the longitudinal direction of the lower of said arms.

2. A reed dent according to claim 1; further characterized in that the bend point and thus the vertex between the two arms of the reed dent lies at about the level of said recess.

3. A reed dent according to claim 2 wherein said recess is disposed between two nose-shaped projections disposed respectively on said two arms.

4. A reed dent according to claim 3 wherein said reed dent has a lower part adjoining a batten and an upper part which is tilted with respect to said lower part and inclined toward the fell, the reed having a weft guide channel which is formed by recesses provided in the reed dents.

* * * * *